United States Patent [19]

Yake et al.

[11] 3,960,290

[45] June 1, 1976

[54] UTILITY BASKET FOR A DISHWASHER

[75] Inventors: William H. Yake; Donald G. Wallace, both of Connersville, Ind.

[73] Assignee: Design and Manufacturing Corporation, Connersville, Ind.

[22] Filed: May 8, 1974

[21] Appl. No.: 468,001

[52] U.S. Cl. ..... 220/338; 220/19; 220/22.1; 220/23.83

[51] Int. Cl.[2] ..... B65D 51/04; B65D 25/06

[58] Field of Search ..... 220/19, 22, 22.1, 22.2, 220/338, 23.83, 23.86

[56] References Cited

UNITED STATES PATENTS

| | | | |
|---|---|---|---|
| 1,326,070 | 12/1919 | Lewis | 220/22 |
| 2,605,926 | 8/1952 | Casey | 220/338 |
| 3,050,073 | 8/1962 | McMillan | 220/19 |
| 3,086,676 | 4/1963 | Dilatush | 220/338 |
| 3,460,850 | 8/1969 | Franklin | 220/19 |

*Primary Examiner*—George E. Lowrance
*Attorney, Agent, or Firm*—Melville, Strasser, Foster & Hoffman

[57] ABSTRACT

A utility basket for use in the upper or lower rack of a dishwasher. The utility basket comprises an elongated, narrow structure having side walls, end walls and a bottom. A gate is hingedly affixed within the utility basket to one of the side walls thereof. The gate is swingable between first and second positions. In its first position the gate lies against the side wall to which it is hinged and the entire utility basket is available to receive long flatware such as cooking spoons, spatulas and the like. In its second position the gate extends transversely of the utility basket serving as a partition to divide the utility basket into a first ordinary table utensil receiving portion and a second, shorter small wares receiving portion for small items such as measuring spoons, jar lids and the like. Means are provided to maintain the gate in its first and its second positions. The utility basket is also provided with a hinged lid swingable between an open position wherein it lies outside the utility basket and a closed position wherein it covers the small wares portion of the utility basket as defined by the gate. Means are provided to maintain the lid in its closed position. The utility basket side walls, bottom, gate and lid are of foraminous construction to permit wash and rinse waters to pass freely therethrough.

5 Claims, 15 Drawing Figures

UTILITY BASKET FOR A DISHWASHER

BACKGROUND OF THE INVENTION

1. Field of the Invention

The invention relates to a utility basket, and more particularly to a utility basket for use in the upper or lower rack of a dishwasher and capable in one mode to receive long flatware and in another mode to receive ordinary table utensils and small wares, the small wares being fully enclosed.

2. Description of the Prior Art

In its usual form a dishwasher, whether of the top loading or front loading variety, comprises a cabinet surrounding a vat. Upper and lower racks for tableware are mounted in the vat and means are provided to shower the tableware with wash and rinse waters and to dry the tableware, in accordance with the various cycles the dishwashing machine is capable of performing.

It is usual practice to provide either the upper or lower rack of a dishwasher with a separate or integral basket for table utensils such as knives, forks, spoons and the like. In some instances the basket is so sized as to hold the table utensils in a horizontal position, while in other instances the table utensils are maintained in an upright position.

Heretofore, prior art workers have also provided, as a part of the table utensil basket or as a separate basket, means to hold small wares, such as measuring spoons, jar lids and the like. In most instances, even when not constituting an integral part of the upper or lower rack, the table utensil and/or small wares basket is intended to be accommodated only in one position within one of the upper and lower racks. In some prior art versions the table utensil and/or small wares basket is provided with upstanding handle means which further restricts its placement within the upper or lower rack.

Heretofore, no particular provision has been made in baskets in the racks for the accommodation of long flatware, such as cooking spoons, spatulas, carving knives and the like. It is generally necessary to locate such items in other portions of the upper or lower rack as best one can among the tableware, or to the exclusion of other tableware. Difficulties are sometimes encountered by virtue of the shifting of such items during the washing operation or during loading or unloading the dishwashing machine.

The present invention is directed to a utility basket wholly separate from the upper and lower rack structures. The utility basket may be located in various positions within the upper or lower rack. In a first mode, the utility basket is unobstructed throughout its length. In a second mode, the utility basket is divided into first and second portions. While not so limited the utility basket will be described as being of such dimensions that in its first mode it is capable of accommodating long flatware and in its second mode the first portion will be open and of sufficient length to receive ordinary table utensils and its second portion will be shorter and intended for the receipt of small wares, the second portion having lid means to retain the small wares during the spraying of wash and rinse waters.

The utility basket of the present invention is of simple construction and inexpensive to manufacture. By virtue of its versatility, it permits the most advantageous use of the space in the rack in which it is located. The ability to place the utility basket in either the upper or lower rack is advantageous because it enables plastic handled items and the like to be washed in the upper rack at a greater distance from the dishwasher heating coil.

SUMMARY OF THE INVENTION

The utility basket of the present invention comprises a structure having side walls, end walls and a bottom. The utility basket may be of such length as to easily accommodate the usual long flatware.

Hingedly affixed within the basket, to one of the side walls, is a gate. In a first position the gate is located against the side wall to which it is hinged, thereby rendering the entire length of the interior of the utility basket substantially unobstructed. Means are provided to maintain the gate in this first position. The gate is also swingable to a second position wherein it serves as a partition for the interior of the utility basket, dividing the utility basket into a first section which may be of such length and size as to accommodate ordinary table utensils and a second portion which may be of such size as to receive small wares. Means are also provided to maintain the gate in its second position.

A lid is pivotally affixed to the utility basket. The lid is swingable between a first position wherein it lies wholly outside the utility basket again rendering the entire length of the utility basket free for the receipt of long flatware. In its second position, the lid encloses the small wares portion of the utility basket, as defined by the gate when in its second position.

The side walls, end walls, bottom, gate and lid of the utility basket form a completely self-contained structure with no separate parts which must be manipulated and stored when not in use. Some or all of the above listed parts of the utility basket are of foraminous construction permitting wash and rinse waters to readily pass therethrough.

BRIEF DESCRIPTION OF THE DRAWINGS

FIG. 9 is a side elevational view of the gate.

FIG. 12 is a fragmentary cross-sectional view taken along section line 12—12 of FIG. 10.

FIG. 14 is a fragmentary plan view of the utility basket of the present invention showing the gate in its second or closed position and the lid in its closed position.

FIG. 15 is a fragmentary elevational view of the utility basket of FIG. 14.

DESCRIPTION OF THE PREFERRED EMBODIMENTS

Figure 1:
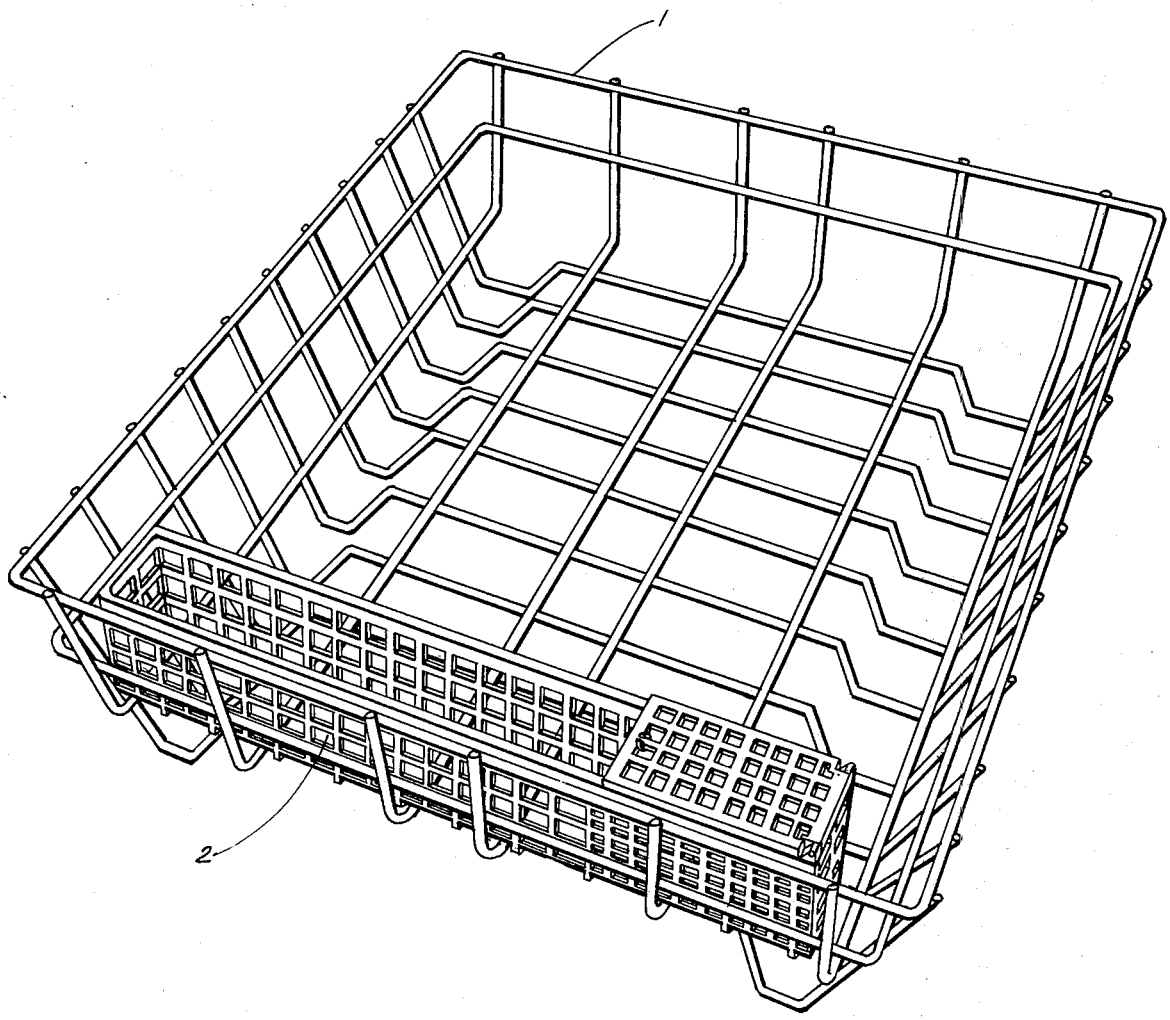
FIG. 1 is a perspective view of a dishwasher rack with the utility basket of the present invention diagrammatically indicated therein.

FIG. 1 illustrates a typical and representative rack structure for a dishwasher. The rack 1 of FIG. 1 may be considered to be either an upper or lower dishwasher rack. When used in a front loading dishwasher, the rack 1 will normally be provided with wheels, glide means or the like (not shown) whereby the rack may be withdrawn from the dishwasher vat for loading and unloading. In FIG. 1, the utility basket of the present invention is diagrammatically shown and is generally designated by the index numeral 2. For purposes of an exemplary showing, the utility basket 2 is illustrated as being located within the rack 1 along the front thereof. It will be obvious from FIG. 1, however, that the utility basket, being a separate structure, may be located at any convenient position within the rack 1.

Figures 2, 3, 4:
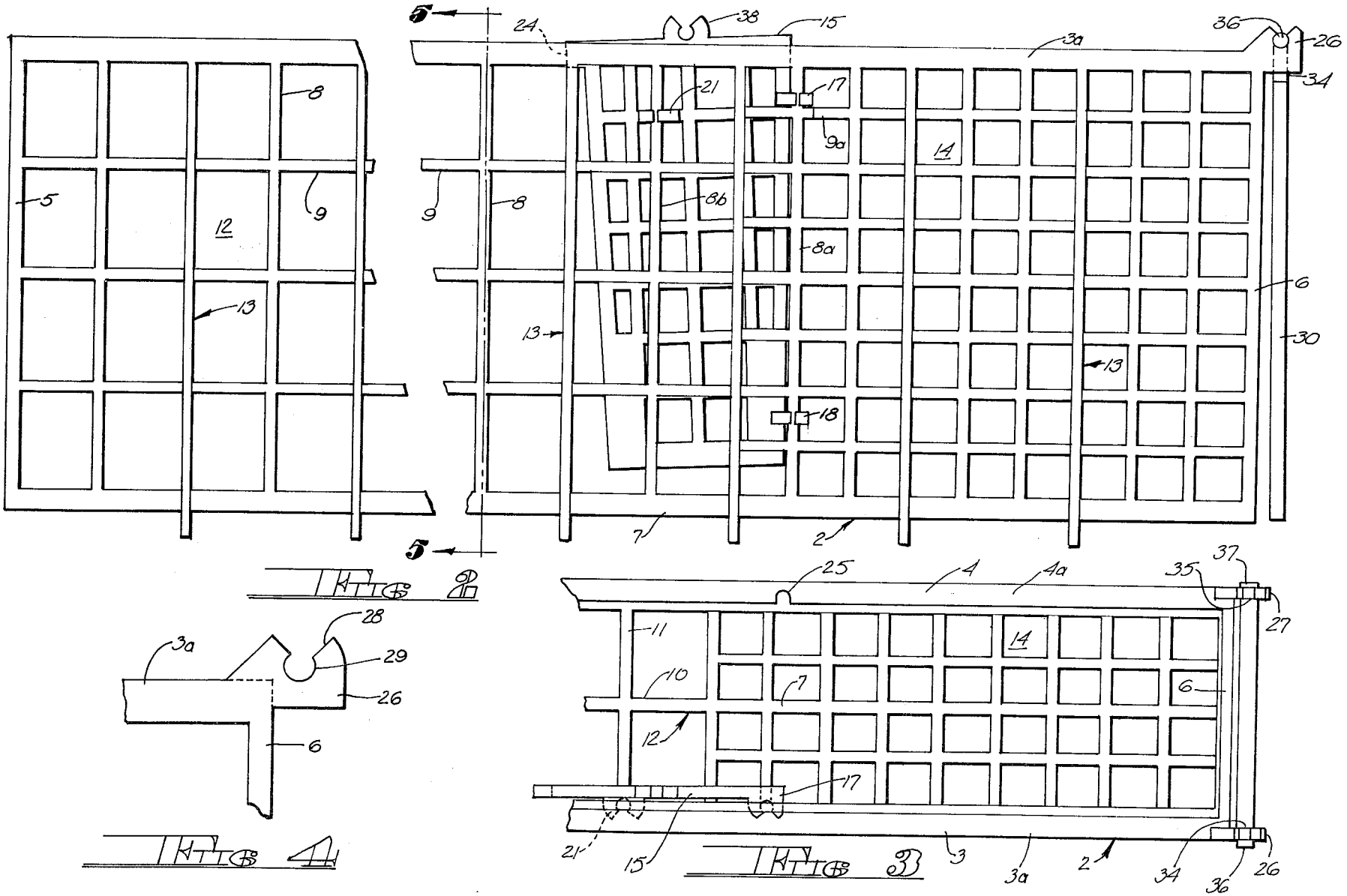
FIG. 2 is a fragmentary side elevational view of the utility basket of the present invention illustrating the gate and lid thereof in their open positions.
FIG. 3 is a fragmentary top view of the utility basket of FIG. 2.
FIG. 4 is a fragmentary side elevational view of one of the hinge means on the utility basket for the lid.
Figure 5:
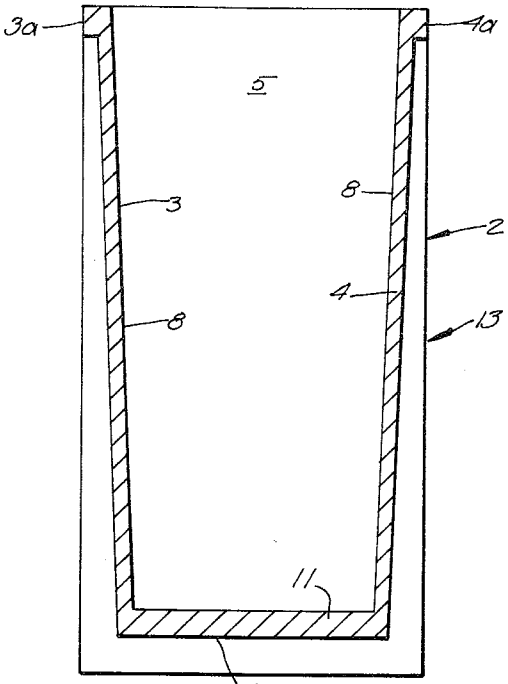
FIG. 5 is a cross-sectional view taken along the section line 5—5 of FIG. 2.

For a better understanding of the utility basket, reference is made to FIGS. 2, 3 and 5. The utility basket comprises a structure having elongated side walls 3 and 4, end walls 5 and 6 and a bottom 7.

The utility basket may be of any appropriate construction permitting the passage of wash and rinse waters therethrough. For example, the utility basket could be constructed of wire mesh utilizing stainless steel or plastic coated wire. For purposes of an exemplary showing it is illustrated as being of a molded plastic construction. Any appropriate plastic may be used so long as it is sufficiently tough and resilient and capable of withstanding the water and temperatures encountered in a dishwasher vat. Excellent results have been achieved when the utility basket has been molded of polypropylene, for example. It will be evident from FIGS. 2, 3 and 5 that the side walls are made up of a plurality of vertical and horizontal ribs 8 and 9, respectively, while the bottom is made up of a plurality of longitudinally extending ribs 10 and transverse ribs 11. These various ribs define rectangular holes, generally indicated at 12 through which wash and rinse waters may readily pass.

Selected ones of the vertical ribs of the utility basket sides are enlarged and extend across the bottom 7, serving not only as support for the utility basket but as stiffening means for the sides 3 and 4 and the bottom 7. Such enlarged ribs are generally indicated at 13 and are clearly shown in FIGS. 2 and 5.

To further strengthen the structure, the ribs 11 of the bottom 7 may be of greater thickness than the ribs 8 of the sides. This is clearly shown in FIG. 5. Finally, the upper longitudinal edges 3*a* and 4*a* of the sides 3 and 4, respectively, may be enlarged. This is illustrated in FIGS. 2, 3 and 5.

Toward the end 6 of the utility basket, the ribs constituting the basket sides 3 and 4 and bottom 7 are more closely spaced defining smaller holes generally indicated at 14. This portion of the utility basket in one mode serves as the small wares section, as will be described hereinafter. The ends 5 and 6 of the utility basket may also be of open work construction similar to adjacent portions of the sides 2 and 3. On the other hand, they may be made up of simple, planar, unperforated panels. The end 5, for example, is so illustrated in FIG. 5.

While the precise dimensions and configuration of the utility basket does not constitute a limitation on the present invention, for purposes of an exemplary showing (see FIG. 5) the basket is illustrated as being relatively narrow and relatively deep, the sides 3 and 4 sloping gently downwardly and toward each other. The overall length of the utility basket should be such that the usual long flatware can be received therein between the ends 5 and 6. By designing the utility basket such that it is relatively narrow and deep, it will have sufficient capacity while enabling it to be placed within the upper or lower dishwasher rack with minimal interference to the placement of additional tableware within the rack.

Figure 10:
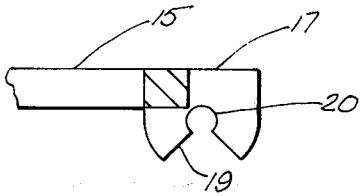
FIG. 10 is an elevational view of the gate of FIGS. 8 and 9.
Figures 8, 9A, 9B, 9D, 10:
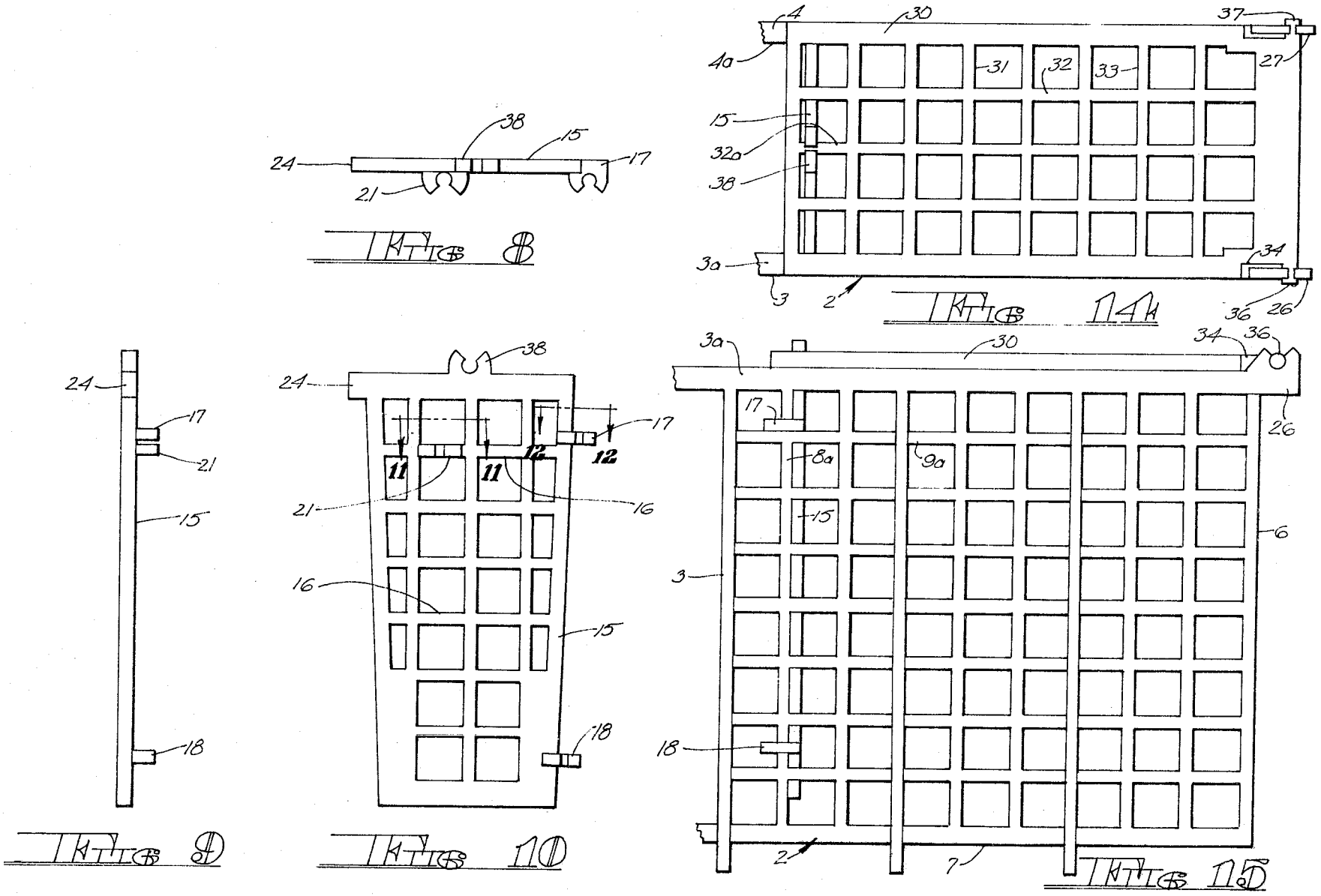
FIG. 8 is a top plan view of the gate.

Attention is drawn to FIGS. 8 through 10 wherein a gate, serving as a partition for the utility basket, is illustrated. The gate 15 comprises a planar structure having a plurality of perforations 16 therethrough so that it has a foraminous construction similar to the side walls 3 and 4 and bottom 7 of the utility basket. The precise nature of the perforations does not constitute a limitation on the present invention.

The peripheral shape of gate 15 is such as to substantially match the interior cross-sectional configuration of the utility basket. This will be evident from a comparison of FIGS. 5 and 10.

Along one edge, the gate 15 is provided with laterally extending hinge lugs 17 and 18. These lugs may be substantially indentical. The hinge lug 17 is clearly shown in FIG. 12. The lug 17 has a notch 19 terminating in a substantially circular opening 20. As is clearly shown in FIGS. 2 and 3, the hinge lugs 17 and 18 are adapted to engage one of the vertical ribs of the side 3 of the utility basket. In FIGS. 2 and 3 the lugs 17 and 18 are shown engaged with vertical rib 8*a*. The gate 15 is maintained at the proper level on vertical rib 8*a* by the abutment of hinge lug 17 with the horizontal rib 9*a*.

Returning for the moment to FIG. 12, it will be understood that the circular opening 20 will have a diameter at least equal to the diagonal cross-sectional dimension of vertical rib 8*a* of FIG. 2. The same of course is true for lug 18. This will assure that the gate 15 will pivot about the rib 8*a*. The width at the point of juncture between the notch 19 and opening 20 of lug 17 will be slightly less than the transverse dimension of vertical rib 8*a* of FIG. 2. Again, the same dimensional relationship will hold for the hinge lug 18. This will assure that hinge lugs 17 and 18 will engage the vertical rib 8*a* with a snap fit.

Figure 11:
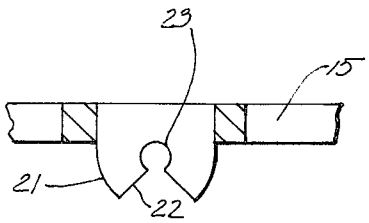
FIG. 11 is a fragmentary cross-sectional view taken along section line 11—11 of FIG. 10.

In FIGS. 2 and 3 the gate 15 is shown in its first or open position wherein it lies adjacent the utility basket wall 3. In this position, the full length of the basket is substantially unobstructed and the basket may receive long flatware. Means may be provided to maintain the gate 15 in its first position. To this end, the gate may be provided with a latch lug 21. The latch lug 21 is clearly shown in FIG. 11. It will be noted that the construction of latch lug 21 is similar to hinge lug 17 (FIG. 12) having a V-shaped notch 22 leading to a substantially circular opening 23 equivalent to the notch 19 and opening 20 of FIG. 12. As will be clear from FIGS. 2 and 3, the latch lug 21 is adapted to engage the vertical rib 8*b* of the utility basket side 3 when the gate is in its first or open position.

FIGS. 14 and 15 illustrate the gate 15 in its second or closed position wherein it serves as a partition for the basket. Means may also be provided to maintain the gate in its second or closed position. Reference is again made to FIGS. 3 and 8 through 10. The side of the gate 15, opposite the side bearing hinge lugs 17 and 18, is provided at its upper end with a laterally extending lug 24.

Turning to FIG. 3 it will be noted that the upper edge 4*a* of side wall 4 has a notch 25 formed therein. The notch is adapted to receive the lug 24 of gate 15 when the gate is in its second or closed position. As a consequence, the gate will be maintained in its closed position until the lug 24 is released from the notch 25. Depending upon the size of the notch 25 and the size of the lug 24, as well as the resilience of the material from which the gate and utility basket are made, the lug 24 may simply snap into the notch 25 upon pivoting the gate to its second or closed position. On the other hand, during the closing procedure the gate may be shifted vertically on the rib 8*a* of utility basket side 3*a* so that when the closed position of the gate is achieved, the gate may be lowered on rib 8*a* simultaneously lowering lug 24 into notch 25.

It will be understood by one skilled in the art that other appropriate means may be substituted for hinge lugs 17 and 18, latch lug 21 and the lug 24. When molded of plastic, however, the embodiments illustrated constitute simple and easy structures for accomplishing the various purposes. The natural resilience of the plastic material will enable a snap engagement of hinge lugs 17 and 18 with the vertical rib 8*a* and a snap engagement of the latch lug 21 with vertical rib 8*b*.

As is clearly shown in FIGS. 2 and 3, the upper corners of the utility basket, at end 6 thereof, are provided with substantially identical hinge lugs 26 and 27. Hinge lug 26 is clearly shown in FIG. 4. In construction hinge lug 26 is substantially equivalent to hinge lug 17 of FIG. 12, having a V-notch 28 leading to a circular opening 29. The notch 28 and opening 29 are equivalent to the notch 19 and opening 20 of FIG. 12.

Figure 7:
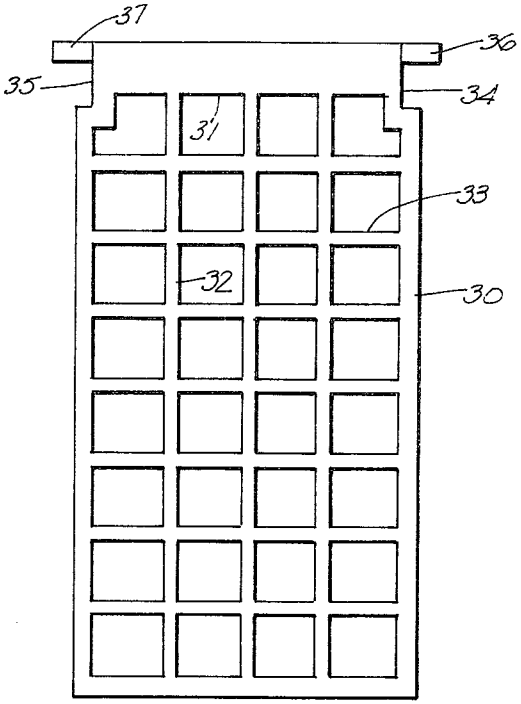
FIG. 7 is a plan view of the lid of FIG. 6.
Figure 6:
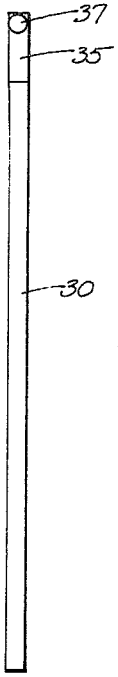
FIG. 6 is a side elevational view of the lid.

FIGS. 6 and 7 illustrate a lid 30 for that portion of the utility basket extending between the gate when in its second or closed position and the utility basket end 6. As will be described hereinafter, this constitutes the small wares portion of the utility basket. The lid 30 comprises a planar member having a plurality of openings 31 therethrough similar to the openings 14 in the sides and bottom of the utility basket (see FIGS. 2 and 3). The openings 31 are so arranged that the lid 30 may be considered to be made up of a plurality of longitudinal ribs 32 and transverse ribs 33.

At one end, the lid 30 is inset as at 34 and 35 so as to accommodate the hinge lugs 26 and 27 of the utility basket (see FIG. 3). Integral, laterally extending pivot pins 36 and 37 are formed on the lid 30 at the insets 34 and 35. The hinge pins 36 and 37 are adapted to engage hinge lugs 26 and 27 with a snap fit so that the lid 30 is pivotable thereabout.

In FIGS. 2 and 3, the lid is illustrated in its open position. It will be noted that in its open position the lid lies wholly outside the utility basket in parallel spaced relationship to the utility basket end 6. The lid is of a length approximately equal to the height of the utility basket end 6 and therefore does not interfere with the placement of the basket within the rack 1 (see FIG. 1) or on any other surface when the lid is in its open position.

FIGS. 14 and 15 illustrate the lid 30 in its closed position. When in its closed position the lid overlies the upper longitudinal edges 3*a* and 4*a* of the utility basket sides 3 and 4.

Figure 13:
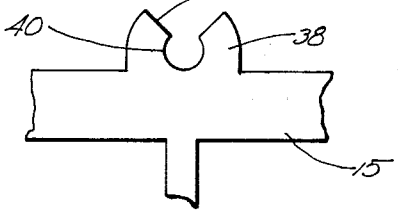
FIG. 13 is a fragmentary elevational view of the catch means on the gate to releasably maintain the lid in its closed position.

Means may also be provided to latch the lid in its closed position. Again referring to FIGS. 14 and 15 it will be noted that the lid 30 extends slightly beyond the gate 15 when the gate is in its second or closed position. The upper edge of the gate may be provided with an upstanding latch lug 38. The latch lug 38 is most clearly shown in FIGS. 10 and 13. The latch lug 38 is substantially identical to latch lug 21 (see FIG. 11) and has a V-shaped notch 39 and circular opening 40 equivalent to the V-notch 22 and circular opening 23 of latch lug 21. As will be evident from FIG. 14, when the lid 30 is in its closed position its longitudinal rib 32*a* will be received within the latch lug 38 of the gate 15 with a snap fit. This will assure that the lid will remain closed during operation of the dishwasher.

The use of the utility basket of the present invention may be described as follows. Since the utility basket is separate and not an integral part of the rack 1, it may be loaded or unloaded while in the rack, or it may be removed from the rack for purposes of loading or unloading.

When it is desired to wash long flatware items the utility basket will be used in a first mode wherein the lid 30 is in its open position and the gate 15 in its first or open and latched position, as shown in FIGS. 2 and 3. In this mode both long flatware and ordinary table utensils may be placed in the basket and washed and dried therein. The basket may be located at any position within one of the dishwasher racks and may be located in the upper or lower rack depending upon the nature of the items being held by the basket.

When it is desired to wash ordinary tableware and small ware items, the gate 15 is pivoted to its second or closed and latched position as shown in FIGS. 14 and 15. Ordinary table utensils may then be placed in that portion of the utility basket extending between the gate 15 and the utility basket end 5. Small wares may be placed in that portion of the basket between the gate 15 and the utility basket end 6. Once the small wares have been placed within the utility basket, the lid 30 may be shifted to its closed and latched position, again as illustrated in FIGS. 14 and 15.

Modifications may be made in the invention without departing from the spirit of it.

The embodiments of the invention in which an exclusive property or privilege is claimed are defined as follows:

1. A utility basket for use in the upper or lower rack of a dishwashing machine, said utility basket comprising a structure having side walls, end walls and a bottom, said side walls being made up of a plurality of vertical and horizontal ribs joined together and defining a plurality of rectangular openings, said utility basket bottom comprising a plurality of longitudinal and transverse ribs joined together and defining a plurality of rectangular openings, a foraminous gate, said gate having a pair of spaced hinge lugs on one side edge thereof engaging a selected one of said vertical ribs of one of said utility basket side walls with a pivotal snap fit, said gate being swingable between first and second positions, said gate in said first position lying against said side wall to which it is hinged rendering the entire utility basket available for the receipt of tableware, said gate in said second position extending transversely of said utility basket to divide said utility basket into first and second portions, means to maintain said gate in said first position comprising a latch lug so located on said gate as to engage with a releasable snap fit another of said vertical ribs of said same utility basket side wall to which said gate is hinged, means to maintain said gate in said second position comprising a lug on the opposite side edge of said gate from said hinge lugs and a notch on the other of said utility basket side walls to receive said last mentioned lug, a lid, means for hingedly affixing said lid to said utility basket, said lid being swingable between an open position and a closed position wherein said lid covers said second portion of said utility basket, said lid being of foraminous construction.

2. The structure claimed in claim 1 wherein said utility basket is molded of plastic material.

3. The structure claimed in claim 1 wherein said lid is hinged to said utility basket along the upper edge of that one of the utility basket end walls nearest said gate when said gate is in its second position, said lid in said open position lying wholly outside said utility basket and depending downwardly along said last mentioned utility basket end wall.

4. The structure claimed in claim 1 wherein said utility basket comprises an elongated narrow structure.

5. The structure claimed in claim 3 wherein said lid comprises a plurality of longitudinal and transverse ribs joined together and defining a plurality of rectangular openings, said means for maintaining said lid in said closed position comprising a latch lug on the top edge of said gate, said latch lug engaging one of said ribs of said lid with a releasable snap fit when said gate is in said second position and said lid is in said closed position.

* * * * *